US009623482B2

(12) United States Patent
Yu et al.

(10) Patent No.: US 9,623,482 B2
(45) Date of Patent: Apr. 18, 2017

(54) METHOD FOR PREPARING R-FE-B BASED SINTERED MAGNET

(71) Applicant: Yantai Zhenghai Magnetic Material Co., Ltd., Yantai (CN)

(72) Inventors: Yongjiang Yu, Yantai (CN); Xiuyan Sun, Yantai (CN); Zhiqiang Li, Yantai (CN); Yulin Wang, Yantai (CN); Lei Liu, Yantai (CN)

(73) Assignee: Yantai Zhenghai Magnetic Material Co., Ltd., Yantai (CN)

( * ) Notice: Subject to any disclaimer, the term of this patent is extended or adjusted under 35 U.S.C. 154(b) by 217 days.

(21) Appl. No.: 14/187,190

(22) Filed: Feb. 21, 2014

(65) Prior Publication Data

US 2014/0352847 A1 Dec. 4, 2014

(30) Foreign Application Priority Data

May 30, 2013 (CN) ..... 2013 1 0209231

(51) Int. Cl.

| | |
|---|---|
| ***B22F 3/26*** | (2006.01) |
| ***H01F 1/057*** | (2006.01) |
| ***H01F 41/02*** | (2006.01) |
| ***C22C 38/00*** | (2006.01) |
| ***C22C 38/06*** | (2006.01) |

(Continued)

(52) U.S. Cl.

CPC ..... *B22F 3/26* (2013.01); *C22C 33/0278* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 1/0577* (2013.01); *H01F 41/0293* (2013.01); *B22F 2998/10* (2013.01); *B22F 2999/00* (2013.01); *C22C 2202/02* (2013.01)

(58) Field of Classification Search

CPC .... B22F 3/26; B22F 1/00; H01F 41/00; H01F 41/02; H01F 1/0577; H01F 41/0293; H02K 21/00; C22C 33/0278; C22C 33/002; C22C 33/005; C22C 33/06; C22C 33/10; C22C 33/14; C22C 33/16

USPC ..... 310/152; 419/1; 148/104

See application file for complete search history.

(56) References Cited

U.S. PATENT DOCUMENTS 4,411,936 A * 10/1983 Schrewelius ..... B09B 3/0041 427/367

6,566,635 B1 * 5/2003 Matsen ..... H05B 6/105 219/633

(Continued)

*Primary Examiner* — Jessee Roe

*Assistant Examiner* — John Hevey

(74) *Attorney, Agent, or Firm* — Matthias Scholl, PC; Matthias Scholl

(57) ABSTRACT

A method for preparing an R—Fe—B based sintered magnet, including: preparing a $R_1$—Fe—B-M sintered magnet having a thickness of between 1 and 10 mm; spraying a layer of Tb or Dy having a thickness of between 10 and 200 μm on each surface of the sintered magnet in a sealed box under an Ar atmosphere by hot spraying method; and transferring the sintered magnet coated with the layer of Tb or Dy to a vacuum sintering furnace, heating the sintered magnet at the temperature of between 750 and 1000° C. in a vacuum condition or under the Ar atmosphere, and allowing heavy rare earth element Tb or Dy to enter an inner part of the sintered magnet via grain boundary diffusion.

14 Claims, 1 Drawing Sheet

(51) Int. Cl.

| | |
|---|---|
| ***C22C 38/10*** | (2006.01) |
| ***C22C 38/14*** | (2006.01) |
| ***C22C 38/16*** | (2006.01) |
| ***C22C 33/02*** | (2006.01) |

(56) References Cited

U.S. PATENT DOCUMENTS

| | | | | |
|---|---|---|---|---|
| 6,680,085 | B2 * | 1/2004 | Kley | C23C 4/131 219/76.16 |
| 2006/0231409 | A1 * | 10/2006 | Sakamoto | C25D 3/38 205/292 |
| 2007/0034299 | A1 * | 2/2007 | Machida | H01F 41/0293 148/105 |
| 2009/0322459 | A1 * | 12/2009 | Nagata | H01F 41/0293 335/302 |
| 2011/0189498 | A1 * | 8/2011 | Nagata | C21D 1/72 428/596 |
| 2012/0091844 | A1 * | 4/2012 | Nakajima | C22C 38/005 310/152 |

* cited by examiner

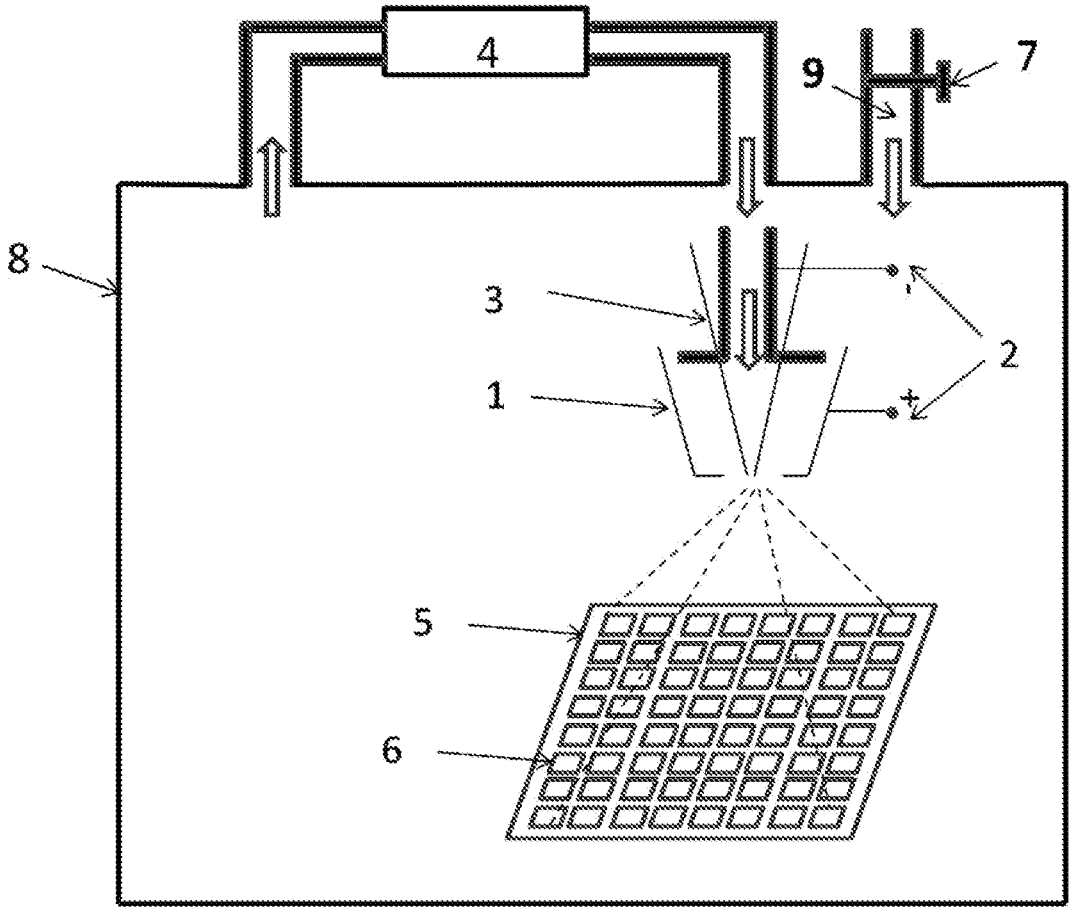
4
9
7
8
3
2
1
5
6

METHOD FOR PREPARING R-FE-B BASED SINTERED MAGNET

CROSS-REFERENCE TO RELATED APPLICATIONS

Pursuant to 35 U.S.C. §119 and the Paris Convention Treaty, this application claims the benefit of Chinese Patent Application No. 201310209231.9 filed May 30, 2013, the contents of which are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

Field of the Invention

The invention relates to a method for preparing R—Fe—B based sintered magnet.

Description of the Related Art

R—Fe—B rare earth sintered magnet has been fast developed and widely applied to the field of the computer hard disk, hybrid power automobile, medical, and wind power generation industries due to its high strength, excellent magnetic properties, and low cost.

Coercivity is a significant index for measuring the magnetic properties of the rare earth sintered magnet, and a typical method for improving the coercivity of the magnet is to add rare earth raw material of pure metal or alloy including Tb or Dy during the melting process. Grain boundary diffusion is a method for diffusing Tb or Dy, which includes melting the grain boundary at high temperature, and diffusing Tb or Dy from the surface along the gain boundary of the magnet to an inner part of the sintered magnet. The method highly improves the utilization rate of the heavy rare earth elements, lowers the usage amount of the heavy rare earth elements, and largely improves the coercivity of the magnet.

Conventional methods for preparing R—Fe—B based sintered magnets includes slurry coating process, vacuum evaporating process, and tumble-plating process.

The slurry coating process includes preparing a slurry including an oxide, fluoride, or oxyfluoride of Tb or Dy, coating the slurry on the surface of the sintered magnet, and placing the coated sintered magnet in a sintering furnace for high temperature treatment and aging treatment after drying, allowing Tb or Dy to enter the inner part of the sintered magnet by gain boundary diffusion. The method has a complicate operation, a large amount of Tb or Dy powder is attached to the magnet piece after treatment, which requires further machining or washing for removal. The process is complicate and easily results in waste. Besides, the slurry coated on the surface of the magnet is still in the form of powder after being dried, thereby being easily falling off, and the increase of the coercivity of the magnet after treatment is not dramatic.

The vacuum evaporating process has high requirement on the evaporation rate of the evaporation source, the evaporation concentration, the temperature, the vacuum degree, and the operating system. However, a distance exists between the magnet to be treated and the evaporation source, so that the space utilization is decreased and the production cost of the treatment is relatively high.

The tumble-plating process includes contacting the rare earth magnet with the diffusion source of the heavy rare earth metal or alloy thereof, and diffusing the heavy rare earth elements to the inner part of the sintered magnet at the high temperature by using tumble-plating like process. Because the diffusion of the heavy rare earth elements to the inner part of the sintered magnet is on the premise that the grain boundary is melted at the high temperature, whereas Pr and Nd in the melted grain boundary are easily replaced by the heavy rare earth elements, so that the sintered magnet and the heavy rare earth elements or alloy are easily stuck together once the movement is not in time, thereby being poorly practical.

SUMMARY OF THE INVENTION

In view of the above-described problems, it is one objective of the invention to provide a method for preparing an R—Fe—B based sintered magnet that has simple operation, low production cost, high yields, and highly improved performance of the magnet.

To achieve the above objective, in accordance with one embodiment of the invention, there is provided a method for preparing an R—Fe—B based sintered magnet, the method comprising:

1) preparing a $R_1$—Fe—B-M sintered magnet using a well-known method of the field, where $R_1$—Fe—B-M sintered magnet comprises: between 26 and 33 wt. % of $R_1$ being selected from the group consisting of Nd, Pr, Dy, Tb, Ho, Gd, or a combination thereof; between 0 and 5 wt. % of M being selected from the group consisting of Ti, V, Cr, Mn, Co, Ni, Ga, Ca, Cu, Zn, Si, Al, Mg, Zr, Nb, Hf, Ta, W, Mo, or a combination thereof; between 0.5 and 2 wt. % of B; and the rest Fe;
2) degreasing, acid washing, activating, and washing by deionized water the $R_1$—Fe—B-M sintered magnet obtained from step 1);
3) placing the sintered magnet after being washed in a sealed box under a circulating Ar atmosphere; and employing Tb or Dy as a coating material, and coating a layer of the coating material having a thickness of between 10 and 200 μm on each surface of the sintered magnet by hot spraying;
4) placing the sintered magnet obtained from step 3) in a vacuum sintering furnace, heating the sintered magnet at a temperature of between 750 and 1000° C. for between 2 and 72 hrs; and controlling a vacuum degree of the vacuum sintering furnace at between $10^{-2}$ and $10^{-5}$ Pa or controlling an Ar pressure in the vacuum sintering furnace of between 5 and 20 kPa to allow Tb or Dy to enter an inner part of the sintered magnet via grain boundary diffusion; and
5) aging the sintered magnet obtained from step 4) at a temperature of between 450 and 600° C. for between 1 and 10 hrs to obtain the R—Fe—B based sintered magnet.

In a class of this embodiment, in step 3), the thickness of the layer of the coating material is between 20 and 100 μm.

In a class of this embodiment, a box body of the sealed box is provided with an Ar gas inlet and an Ar gas control valve; a compressor is disposed outside the box body for maintaining a stable pressure inside the box body.

In a class of this embodiment, the sintered magnet is compactly arranged inside the sealed box before hot spraying, when one side of the sintered magnet is hot sprayed, the sintered magnet is turned over to allow the other side of the sintered magnet to be hot sprayed.

In a class of this embodiment, in step 4), when using Tb as the coating material, the temperature is controlled at between 850 and 970° C. in the vacuum sintering furnace, the time for heat treat mentis controlled at between 5 and 72 hrs, and the vacuum degree in the vacuum sintering furnace is controlled at between $10^{-3}$ and $10^{-4}$ Pa or the Ar pressure in the vacuum sintering furnace is controlled at between 5 and 10 kPa. When using Dy as the coating material, the temperature is controlled at between 800 and 950° C. in the vacuum sintering furnace, the time for heat treat mentis controlled at between 5 and 72 hrs, and the vacuum degree in the vacuum sintering furnace is controlled at between $10^{-3}$ and $10^{-4}$ Pa or the Ar pressure in the vacuum sintering furnace is controlled at between 5 and 10 kPa.

In a class of this embodiment, the aging treatment in step 5) is conducted at the temperature of between 470 and 550° C. for between 2 and 5 hrs.

Advantages of the invention are summarized as follows: A layer of Tb or Dy is coated on the surface of the R—Fe—B based sintered magnet by hot spraying, and the sintered magnet is then heated to allow Tb or Dy coated on the surface of the sintered magnet to enter the inner part of the sintered magnet by grain boundary diffusion, so that the coercivity of the sintered magnet is largely improved. Compared with other methods including surface coating and vacuum evaporation for grain boundary diffusion, the method of the invention is capable of directly spraying heavy rare earth metals on the surface of the sintered magnet, thereby resulting in a close contact and a good diffusive effect of Tb or Dy. The method features easy operation, high efficiency, high yield, no requirement of washing treatment of the sintered magnet after treatment, good appearance, and high practical significance.

BRIEF DESCRIPTION OF THE DRAWINGS

The invention is described hereinbelow with reference to accompanying drawings, in which the sole FIGURE is a structure diagram of a device for hot spraying treatment in accordance with one embodiment of the invention.

In the drawing, the following reference numbers are used: 1. Hot spray gun; 2. Input end; 3. Terbium (Tb) or dysprosium (Dy) wire; 4. Compressor; 5. Ceramic plate; 6. Magnet piece; 7. Ar gas control valve; 8. Sealed box; and 9. Ar gas inlet.

DETAILED DESCRIPTION OF THE EMBODIMENTS

For further illustrating the invention, experiments detailing a method for preparing an R—Fe—B based sintered magnet are described below. It should be noted that the following examples are intended to describe and not to limit the invention.

A sintered magnet to be treated herein is prepared using a well-known method for an ordinary skill in the art. A device for hot spraying treatment of the sintered magnet, as shown in FIG. 1, comprises a hot spray gun 1, a compressor 4, an Ar gas control valve 7, a sealed box 8, and an Ar gas inlet 9. The hot spray gun 1 employed in the device is a common arc spray gun and is arranged vertically inside the sealed box 8. Magnet pieces 6 are arranged right beneath the hot spray gun 1 and a distance between the hot spray gun 1 and the magnet pieces is between 0.2 and 1 m. The compressor 4 is arranged outside the sealed box 8 for Ar circulation inside a box body of the sealed box 8. The Ar gas control valve 7 is disposed on a top of the box body of the sealed box 8 for controlling the Ar gas to enter the sealed box 8 via the Ar gas inlet 9 to maintain a stable pressure inside the box body.

When the hot spray gun 1 works, a three-phase AC is input via an input end 2, a Tb or Dy wire 3 is immediately heated and melted under the action of an electric arc and is sprayed on the magnet pieces 6 arranged on a ceramic plate 5 at a high speed under the action of compressed Ar gas. A 380 V, 50 Hz three-phase AC is input during the operation of the hot spray gun, and an output power reaches 20 kW. The Tb or Dy wire 3 employed has a diameter of between 2 and 5 mm, and a feeding speed thereof is controlled by a wire feeder. Ar gas is used as a protection atmosphere in the sealed box 8, and the pressure in the box body is controlled to be stable by controlling the Ar control valve 7 and the compressor 4.

A plurality of magnet pieces 6 are compactly arranged inside the box body of the sealed box for improving the number and efficiency of the magnet pieces to be treated. After one side of the magnet piece 6 is treated by hot spraying, the magnet piece 6 is turned over for allowing the other side of the magnet piece 6 to be hot sprayed.

During the process of hot spraying, the feeding speed is appropriately selected for controlling the speed of spraying Tb or Dy on the surface of the magnet piece. The higher the feeding speed and the spraying speed are, the shorter the treatment time is, thereby resulting in a rough coating layer with a poor uniformity. The lower the feeding speed is, the lower the spraying speed is, thereby obtaining a compact and uniform coating layer with a relatively lower yield.

In this embodiment, the sintered magnet is placed in a vacuum sintering furnace after the surface of the sintered magnet being coated with the layer of Tb or Dy. When using Tb as the coating material, the temperature of the vacuum sintering furnace is controlled at between 800 and 1000° C., preferably at between 850 and 970° C.; the time for heat treatment is controlled at between 2 and 72 hrs, preferably at between 5 and 72 hrs; and the pressure inside the vacuum sintering furnace is controlled at between $10^{-2}$ and $10^{-5}$ Pa, and preferably between $10^{-3}$ and $10^{-4}$ Pa, or between 5 and 20 kPa of Ar atmosphere. When using Dy as the coating material, the temperature in the vacuum sintering furnace is controlled between 750 and 1000° C., and preferably between 800 and 950° C.; and the heat treatment is conducted under between 5 and 20 kPa of Ar atmosphere for controlling the evaporation and diffusion speed of Dy.

If the temperature inside the vacuum sintering furnace is below 750° C., the speed of Tb or Dy atoms attached on the surface of the sintered magnet for diffusing to the grain boundary becomes lowered, and the Tb or Dy atoms are effectively prevented from entering the inner part of the sintered magnet, so that a too high concentration of the Tb or Dy atoms distributed on the surface is resulted while a low content or even none of the Tb or Dy atoms enters an inner part of the sintered magnet. If the temperature in the vacuum sintering furnace is above 1000° C., the Tb or Dy atoms are diffused to the inner part of the grain, while the performance of the surface of the sintered magnet becomes poor, thereby leading in a large decrease in the remanence and the maximum energy product.

If the time for heat treatment is shorter than 2 hrs, the Tb or Dy coated on the surface by hot spraying is incapable of totally diffusing to the inner part of the sintered magnet, thereby resulting in that the surface performance of the sintered magnet is higher than that of the inner part thereof, the uniformity of the sintered magnet becomes poor, and the integral performance is not obviously improved. If the time for heat treatment is longer than 72 h, the rare earth element like Pr and Nd continues to evaporate after the Tb or Dy attached to the surface of the sintered magnet is dissipated (by entering the inner part of the sintered magnet by diffusion, or being evaporated to the atmosphere of the treating chamber), thereby resulting in a poor performance of the sintered magnet.

Finally, when the above treatments are conducted for the required time, the temperature in the vacuum sintering furnace is lowered to 200° C. below by stopping heating. After that, the vacuum sintering furnace is heated again to allow the temperature to rise to between 450 and 600° C., preferably between 470 and 550° C., the heat treatment lasts for between 1 and 10 hrs, and preferably between 2 and 5 hrs. When the heat treatment is conducted for required duration, Ar is charged for cooling the vacuum sintering furnace to the room temperature.

Example 1

A mixture was prepared that comprised 23.8 wt. % of Nd, 5 wt. % of Pr, 0.6 wt. % of Dy, 0.4 wt. % of Tb, 68.29 wt. % of Fe, 0.5 wt. % of Co, 0.13 wt. % of Cu, 0.1 wt. % of Ga, 0.1 wt. % of Al, 0.12 wt. % of Zr, and 1 wt. % of B. The mixture was poured in a vacuum melting furnace under an atmosphere of an inactive gas, a pouring temperature was controlled at 1450° C., and a rotational speed of a quenching roller was 60 rpm, so that flakes having a thickness of 0.3 mm were formed. The flakes were pulverized by hydrogen decrepitation and jet milling to yield powder with an average particle size of 3.5 μm. The power was compressed under a 15 KOe magnetic field to form a compact. The compact was then placed in a sintered furnace under an Ar atmosphere and sintered at the temperature of 1100° C. for 5 hrs to obtain a green body. Thereafter, the green body was aged at the temperature of 500° C. for 5 hrs to obtain a sintered blank. The sintered blank is then machined to form magnet pieces of 50 M, labeled as $M_0$, having a size of 40 mm*20 mm*4 mm.

The 50 M sintered magnet (40 mm*20 mm*4 mm) was degreased, washed by acid, activated, washed by deionized water, and desiccated, respectively. 20 pieces*10 pieces of sintered magnets were placed in a hot spraying sealed box and the surface of each sintered magnet was hot sprayed with a layer of Tb having a thickness of 20 μm on one side thereof, the sintered magnet was then turned over in a glove box, and the other side of the sintered magnet was hot sprayed with another layer of Tb having a thickness of 20 μm. The sintered magnet after the hot spraying treatment was transferred to a vacuum sintering furnace, maintained at the temperature of 970° C. at a vacuum condition (under a pressure between $10^{-3}$ and $10^{-4}$ Pa) for 24 hrs, and then aged for 5 hrs at the temperature of 500° C. After that, the vacuum sintering furnace was charged with Ar to be cooled to the room temperature. A firedoor of the vacuum sintering furnace was opened for acquiring a sintered magnet $M_1$. After analyses and measurements, magnetic performances of the sintered magnets were shown in Table 1.

TABLE 1

Comparison of magnetic performance between $M_1$ and $M_0$

| | Density | Br | Hcj | (BH)max | Hk/iHc |
|---|---|---|---|---|---|
| | | | Unit | | |
| Item | (g/cm³) | kGs | kOe | MGOe | — |
| $M_0$ | 7.56 | 14.31 | 15.57 | 49.66 | 0.97 |
| $M_1$ | 7.59 | 14.09 | 26.06 | 47.68 | 0.95 |

From above comparison of magnetic performance between $M_1$ and $M_0$, it is known that the hot spraying of Tb and the heating of the sintered magnet have good effects, that is, the coercivity of 50 M was increased from 15.57 kOe to 26.06 kOe, the coercivity was highly improved while the magnetic remanence, the squareness ratio, and the energy product are slightly lowered. The density of the magnet is slightly increased after being treated at the temperature of 970° C. for 24 hrs. Samples selected from the surface and the central part of the magnet after treatment were performed with energy spectrum analysis (ICP-MS), and results thereof indicated that the Tb content in the surface layer of the sintered magnet was increased by 1.0 wt. %, and the Tb content in the central part of the sintered magnet was increased by 0.4 wt. %, therefore, Tb was completely diffused into the magnet.

Example 2

The method for preparing 50 M magnet piece was the same as that in Example 1 that includes melting, pulverizing, pressing, heating, and wire cutting. The 50 M sintered magnet (40 mm*20 mm*4 mm) was degreased, washed by acid, activated, washed by deionized water, and desiccated, respectively. 20 pieces*10 pieces of sintered magnets were placed in a hot spraying sealed box and the surface of each sintered magnet was hot sprayed with a layer of Tb having a thickness of 20 μm on one side thereof, the sintered magnet was then turned over in a glove box, and the other side of the sintered magnet was hot sprayed with another layer of Tb having a thickness of 20 μm. The sintered magnet after the hot spraying treatment was transferred to a vacuum sintering furnace, maintained at the temperature of 945° C. under an Ar pressure of 5 kPa for 48 hrs, and then aged for 5 hrs at the temperature of 500° C. After that, the vacuum sintering furnace was charged with Ar to be cooled to the room temperature. A firedoor of the vacuum sintering furnace was opened for acquiring a sintered magnet $M_2$. After analyses and measurements, magnetic performances of the sintered magnets were shown in Table 2.

TABLE 2

Comparison of magnetic performance among $M_2$, $M_1$, and $M_0$

| | Density | Br | Hcj | (BH)max | Hk/iHc |
|---|---|---|---|---|---|
| | | | Unit | | |
| Item | (g/cm³) | kGs | kOe | MGOe | — |
| $M_0$ | 7.56 | 14.31 | 15.57 | 49.66 | 0.97 |
| $M_1$ | 7.59 | 14.09 | 26.06 | 47.18 | 0.95 |
| $M_2$ | 7.56 | 14.15 | 26.55 | 48.23 | 0.95 |

From above comparison of magnetic performance between $M_2$ and $M_0$, it is known that the hot spraying of Tb and the heating of the sintered magnet have good effects, that is, the coercivity of 50 M was increased from 15.57 kOe to 26.55 kOe, the coercivity was greatly improved while the magnetic remanence, the squareness ratio, and the energy product are slightly lowered. Compared with $M_1$, the magnetic remanence, the coercivity, and the energy product are slightly improved. Because Ar also functions in preventing the rare earth element from evaporating from the magnet at the high temperature, the density of the sintered magnet almost has no change even with prolonged heat treatment duration. Samples selected from the surface and the central part of the magnet after treatment were performed with energy spectrum analysis (ICP-MS), and results thereof indicated that the Tb content in the surface layer of the sintered magnet was increased by 0.8 wt. %, and the Tb content in the central part of the sintered magnet was increased by 0.4 wt. %, therefore, Tb was completely diffused into the magnet. Compared with $M_1$, the Tb content difference between the central part and the surface of the sintered magnet is decreased.

Example 3

The method for preparing 50 M magnet piece was the same as that in Example 1 that includes melting, pulverizing, pressing, heating, and wire cutting. The 50M sintered magnet (40 mm*20 mm*4 mm) was degreased, washed by acid, activated, washed by deionized water, and desiccated, respectively. 20 pieces*10 pieces of sintered magnets were placed in a hot spraying sealed box and the surface of each sintered magnet was hot sprayed with a layer of Dy having a thickness of 20 μm on one side thereof, the sintered magnet was then turned over in a glove box, and the other side of the sintered magnet was hot sprayed with another layer of Dy having a thickness of 20 μm. The sintered magnet after the hot spraying treatment was transferred to a vacuum sintering furnace, maintained at the temperature of 930° C. for 24 hrs, and then aged for 5 hrs at the temperature of 500° C. After that, the vacuum sintering furnace was charged with Ar to be cooled to the room temperature. A firedoor of the vacuum sintering furnace was opened for acquiring a sintered magnet $M_3$. After analyses and measurements, magnetic performances of the sintered magnets were shown in Table 3.

TABLE 3

Comparison of magnetic performance between $M_0$ and $M_3$

| | Density | Br | Hcj | (BH)max | Hk/iHc |
|---|---|---|---|---|---|
| | | | Unit | | |
| Item | (g/cm$^3$) | kGs | kOe | MGOe | — |
| $M_0$ | 7.56 | 14.31 | 15.57 | 49.66 | 0.97 |
| $M_3$ | 7.55 | 14.15 | 22.68 | 47.35 | 0.97 |

From above comparison of magnetic performance between $M_3$ and $M_0$, it is known that the hot spraying of Dy and the heating of the sintered magnet have good effects, that is, the coercivity of 50 M was increased from 15.57 kOe to 22.68 kOe, the coercivity was greatly improved while the magnetic remanence and the energy product are slightly lowered, while the squareness ratio almost has no variation. Samples selected from the surface and the central part of the magnet after treatment were performed with energy spectrum analysis (ICP-MS), and results thereof indicated that the Dy content in the surface layer of the sintered magnet was increased by 1.3 wt. %, and the Dy content in the central part of the sintered magnet was increased by 0.5 wt. %, so that Dy was completely diffused into the magnet.

Unless otherwise indicated, the numerical ranges involved in the invention include the end values.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for preparing an R—Fe—B based sintered magnet, the method comprising:

1) preparing an $R_1$—Fe—B-M sintered magnet, wherein the $R_1$—Fe—B-M sintered magnet comprises: between 26 and 33 wt. % of $R_1$ being selected from the group consisting of Nd, Pr, Dy, Tb, Ho, Gd, and a combination thereof; between 0 and 5 wt. % of M being selected from the group consisting of Ti, V, Cr, Mn, Co, Ni, Ga, Ca, Cu, Zn, Si, Al, Mg, Zr, Nb, Hf, Ta, W, Mo, and a combination thereof; between 0.5 and 2 wt. % of B; and the rest being Fe;

2) degreasing, acid washing, activating, and washing by deionized water the $R_1$—Fe—B-M sintered magnet obtained from step 1);

3) placing the sintered magnet obtained from step 2) in a sealed box comprising a hot spray gun under a circulating Ar protective atmosphere; employing Tb or Dy as a coating material, and coating a layer of the coating material having a thickness of between 10 and 200 μm on each surface of the sintered magnet by hot spraying, wherein the hot spraying is performed by feeding a metal wire comprising Tb or Dy into the hot spray gun, turning on the hot spray gun to produce electric arc inside the hot spray gun to heat and melt the metal wire comprising Tb or Dy into melted metal, and then supplying compressed Ar gas into the hot spray gun to atomize the melted metal into droplets and then spraying the droplets out of the hot spray gun toward each surface of the sintered magnet to form a coating layer on each surface of the sintered magnet;

4) placing the sintered magnet obtained from step 3) in a vacuum sintering furnace, heating the sintered magnet at a temperature of between 750 and 1000° C. for between 2 and 72 hrs; and controlling a vacuum degree of the vacuum sintering furnace at between $10^{-2}$ and $10^{-5}$ Pa or controlling an Ar pressure in the vacuum sintering furnace at between 5 and 20 kPa to allow Tb or Dy to enter an inner part of the sintered magnet via grain boundary diffusion; and 5) aging the sintered magnet obtained from step 4) at a temperature of between 450 and 600° C. for between 1 and 10 hrs to obtain the R—Fe—B based sintered magnet.

2. The method of claim 1, wherein in step 3), the thickness of the layer of the coating material is between 20 and 100 μm.

3. The method of claim 1, wherein a box body of the sealed box is provided with an Ar gas inlet and an Ar gas control valve; a compressor is disposed outside the box body for maintaining a stable pressure inside the box body.

4. The method of claim 1, wherein the sintered magnet is compactly arranged inside the sealed box before the hot spraying, when one side of the sintered magnet is hot sprayed, the sintered magnet is turned over to allow the other side of the sintered magnet to be hot sprayed.

5. The method of claim 1, wherein in step 4), when using Tb as the coating material, the temperature in the vacuum sintering furnace is controlled at between 850 and 970° C., the time for heat treatment is controlled between 5 and 72 hrs, and the vacuum degree in the vacuum sintering furnace is controlled at between $10^{-3}$ and $10^{-4}$ Pa or the Ar pressure in the vacuum sintering furnace is controlled at between 5 and 10 kPa; and when using Dy as the coating material, the temperature in the vacuum sintering furnace is controlled at between 800 and 950° C., the time for heat treatment is controlled between 5 and 72 hrs, and the vacuum degree in the vacuum sintering furnace is controlled at between $10^{-3}$ and $10^{-4}$ Pa or the Ar pressure in the vacuum sintering furnace is controlled at between 5 and 10 kPa.

6. The method of claim 1, wherein the aging treatment in step 5) is conducted at the temperature of between 470 and 550° C. for between 2 and 5 hrs.

7. A method for preparing an R—Fe—B based sintered magnet, the method comprising:

1) preparing an $R_1$—Fe—B-M sintered magnet, wherein the $R_1$—Fe—B-M sintered magnet comprises: between 26 and 33 wt. % of $R_1$ being selected from the group consisting of Nd, Pr, Dy, Tb, Ho, Gd, and a combination thereof; between 0 and 5 wt. % of M being selected from the group consisting of Ti, V, Cr, Mn, Co, Ni, Ga, Ca, Cu, Zn, Si, Al, Mg, Zr, Nb, Hf, Ta, W, Mo, and a combination thereof; between 0.5 and 2 wt. % of B; and the rest being Fe;

2) degreasing, acid washing, activating, and washing by deionized water the $R_1$—Fe—B-M sintered magnet obtained from 1);

3) placing the sintered magnet obtained from 2) in a sealed box under a circulating Ar protective atmosphere; employing Tb or Dy as a coating material, and coating a layer of the coating material having a thickness of between 10 and 200 μm on each surface of the sintered magnet by hot spraying; wherein a hot spray gun is disposed in the sealed box; a feeding device is connected to the hot spray gun; the feeding device feeds a metal wire to the hot spray gun; the metal wire comprises Tb or Dy; and the hot spraying is performed by turning on the hot spray gun to produce electric arc inside the hot spray gun to heat and melt the metal wire into melted metal, and then directing compressed Ar gas into the hot spray gun to atomize the melted metal into droplets and then spraying the droplets out of the hot spray gun toward each surface of the sintered magnet to form the coating layer on each surface of the sintered magnet;

4) placing the sintered magnet obtained from 3) in a vacuum sintering furnace, heating the sintered magnet at a temperature of between 750 and 1000° C. for between 2 and 72 hrs; and controlling a vacuum degree of the vacuum sintering furnace at between $10^{-2}$ and $10^{-5}$ Pa or controlling an Ar pressure in the vacuum sintering furnace at between 5 and 20 kPa to allow Tb or Dy to enter an inner part of the sintered magnet via grain boundary diffusion; and 5) aging the sintered magnet obtained from 4) at a temperature of between 450 and 600° C. for between 1 and 10 hrs to obtain the R—Fe—B based sintered magnet.

8. The method of claim 7, wherein in 3), a thickness of the layer of the coating material is between 20 and 100 μm.

9. The method of claim 7, wherein a box body of the sealed box is provided with an Ar gas inlet and an Ar gas control valve; and a compressor is disposed outside the box body of the sealed box for maintaining a stable pressure inside the box body of the sealed box.

10. The method of claim 7, wherein the sintered magnet is compactly arranged inside the sealed box before the hot spraying, when one side of the sintered magnet is hot sprayed, the sintered magnet is turned over to allow the other side of the sintered magnet to be hot sprayed.

11. The method of claim 7, wherein in 4), when using Tb as the coating material, the temperature in the vacuum sintering furnace is controlled at between 850 and 970° C., the time for heat treatment is controlled between 5 and 72 hrs, and the vacuum degree in the vacuum sintering furnace is controlled at between $10^{-3}$ and $10^{-4}$ Pa or the Ar pressure in the vacuum sintering furnace is controlled at between 5 and 10 kPa; and when using Dy as the coating material, the temperature in the vacuum sintering furnace is controlled at between 800 and 950° C., the time for heat treatment is controlled between 5 and 72 hrs, and the vacuum degree in the vacuum sintering furnace is controlled at between $10^{-3}$ and $10^{-4}$ Pa or the Ar pressure in the vacuum sintering furnace is controlled at between 5 and 10 kPa.

12. The method of claim 7, wherein the aging treatment in 5) is conducted at the temperature of between 470 and 550° C. for between 2 and 5 hrs.

13. The method of claim 7, wherein in 3):

a three-phase AC electric power at 380 V, 50 Hz is supplied to the hot spray gun during the hot spraying; and the metal wire has a diameter of between 2 and 5 mm.

14. The method of claim 7, wherein the hot spray gun has an output power of 20 kW.

* * * * *